US005180509A

United States Patent [19]

Jacobs

[11] Patent Number: 5,180,509

[45] **Date of Patent: * Jan. 19, 1993**

[54] METAL-FREE LUBRICANT COMPOSITION CONTAINING GRAPHITE FOR USE IN THREADED CONNECTIONS

[76] Inventor: Norman L. Jacobs, 4/24 Blaxland Rd., Bellevue Hill, Sydney N.S.W. 2023, Australia

[ * ] Notice: The portion of the term of this patent subsequent to Sep. 17, 2008 has been disclaimed.

[21] Appl. No.: 682,276

[22] Filed: Apr. 9, 1991

Related U.S. Application Data

[63] Continuation-in-part of Ser. No. 418,024, Oct. 10, 1989, Pat. No. 5,049,289.

[51] Int. Cl.[5] ..... C10M 125/02

[52] U.S. Cl. ..... 252/22; 252/29; 252/30

[58] Field of Search ..... 252/22, 29, 30

[56] References Cited

U.S. PATENT DOCUMENTS

| | | | |
|---|---|---|---|
| 300,024 | 6/1884 | Smalley . | |
| 1,304,477 | 5/1919 | Guay . | |
| 1,395,073 | 10/1921 | Willey . | |
| 2,176,879 | 10/1939 | Bartell . | |
| 2,419,144 | 4/1947 | Kelly . | |
| 2,645,582 | 7/1953 | Ley . | |
| 3,089,849 | 5/1963 | Linson . | |
| 3,117,085 | 1/1964 | Rees et al. . | |
| 3,242,075 | 3/1966 | Hunter | 252/29 |
| 3,384,580 | 5/1968 | Peace | 252/29 |
| 3,933,657 | 1/1976 | Seni et al. | 252/29 |
| 4,052,323 | 10/1977 | Feneberger et al. . | |
| 4,372,861 | 2/1983 | Chao . | |
| 4,713,186 | 12/1987 | Kristen et al. . | |

*Primary Examiner*—Jacqueline Howard
*Attorney, Agent, or Firm*—Armstrong, Nikaido, Marmelstein, Kubovcik & Murray

[57] ABSTRACT

A metal-free lubricant composition for use in threaded tube and pipe connections includes graphite and a substantially nonabrasive, friction increasing adjusting component, both dispersed in a lubricant base material in which a polyalkylene is dissolved, with the graphite being present in an amount effect to decrease a coefficient of friction of said composition, the friction increasing adjusting component being present in an amount effective to increase the coefficient of friction of the composition, and the polyalkylene being present in an amount effective to enhance formation of graphite flakes from graphite particles upon application of pressure. The lubricant composition can provide corrosion resistance as well as similar or superior lubricating properties in comparison to conventional metal-containing grease compositions.

14 Claims, No Drawings

METAL-FREE LUBRICANT COMPOSITION CONTAINING GRAPHITE FOR USE IN THREADED CONNECTIONS

This application is a continuation-in-part of my copending U.S. application Ser. No. 418,024 filed Oct. 10, 1989, now U.S. Pat. No. 5,049,289.

The present invention relates to a metal-free lubricant composition comprising graphite for use in threaded connections.

Lubricant compositions are introduced between opposed solid surfaces, e.g. surfaces of machine parts, in order to prevent these surfaces from coming into contact with each other while facilitating any relative motion between the surfaces.

A lubricant composition comprises a carrier base such that the composition has the form of an oil or grease and the nature of the carrier is selected for the intended use. It can be an oil or grease and can be based on petroleum derivatives, animal or vegetable oils or on various synthetic materials.

Lubricant compositions can include various additives dissolved or dispersed in the carrier when the lubricant is to be used between opposed surfaces subject to high pressure and heavy work loads during use. Suitable additives include inorganic compounds having laminar crystal lattices such as molybdenum disulphide, other soft inorganic compounds such as lead oxide, lime, talc or bentonite, soft organic compounds such as soaps, waxes and fats, soft polymers such as polytetrafluoroethylene or malleable metals such as lead, copper or aluminium.

In the oil and gas production industry, special types of lubricant compositions are used for application between the male and female parts of threaded tube or pipe connections in order to prevent these parts from being welded together and also to provide a fluid tight seal between them during use. Such lubricant compositions (often termed "thread compounds") should permit the threaded connections to be made up and loosened several times during the construction or maintenance of oil and gas wells despite the high work loads exerted on them. Moreover, after make-up of the threaded connections, the lubricant compositions should be capable of providing a fluid tight seal between the threaded parts, even if an oil or gas is flowing at high pressure through the tubing or pipe carrying such connections.

Lubricant compositions for use in threaded connections must have hydrodynamic properties, i.e. the capacity to build up an internal pressure which is sufficient to balance the load on the opposed surfaces, as well as other friction-reducing and wear-reducing properties.

A particular type of lubricant composition especially designed for use in threaded connections is the API Modified Thread Compound as proposed by the American Petroleum Institute in its bulletin 5A2. This API Modified Thread Compound contains 30.5% by weight of particulate lead, 12.2% by weight of particulate zinc, 3.3% by weight of flaked copper and a minor proportion of graphite in a petroleum-based grease. The high proportion of malleable metal particles in this composition make it particularly effective.

If the composition is applied between the male and female parts of a threaded tube or pipe connection to be screwed together, the composition will be subjected to increasing pressures within the reducing spaces between the threaded parts. The metal particles and in particular the lead particles in the composition will be deformed into flakes of various sizes and shapes, due to the inherent malleability and plasticity of the metal. The flakes tend to become elongated in the direction of movement of the threaded parts, that is in the radial direction thereof and flakes having a length of 5 mm or more may be found. The lead flakes will serve to keep the threaded parts apart at their adjacent surfaces, and also to provide a seal between those parts in order to prevent any fluid within the threaded pie or tube connection to escape to the outside. The zinc and copper particles in the AP1 Modified Thread Compound will modify the functional characteristics of the lead particles to a desired extent.

Although API Modified Thread Compound has high performance characteristics, it provides no protection against corrosion and rusting during storage, and the threaded connection may seize due to corrosion. Furthermore, the metal particles in the Thread Compound are toxic to the environment and will contribute heavily to the pollution of surface water on land and sea during use. It has also been found that API Modified Thread Compound can provide insufficient sealing in couplings provided with an O-ring, and it is unsuitable for use with threaded connections of fibreglass.

The object of the invention is to provide a metal-free lubricant composition which can replace API Modified Thread Compound in the lubrication and sealing of threaded pipe or tube connections, and which can give corrosion resistance and which can give similar or even better performance characteristics and which can be used with fibreglass connections.

U.S. Pat. No. 2,419,144 discloses a lubricant composition for use between close fitting metal surfaces to effect a gas tight sealing of the joint there between, and to prevent seizing of the contacting surfaces. This composition comprises 19 to 27% graphite, 11 to 25% talc and 9 to 15% of lithium or barium stearate in 34 to 44% of petroleum-based lubricating oil. However, in practice, the lubricating and extreme pressure characteristics of graphite are adversely affected by the presence of talc. If graphite is contaminated by talc, its flaking characteristics are modified to the extent that flakes produced under compaction are noticeably smaller than those composed of pure graphite. In comparative tests on the extreme pressure lubricating properties of several compositions, samples containing graphite and talc performed worse than those containing graphite free of talc.

The present invention provides a metal free lubricant composition for threaded connections which comprises graphite dispersed in a lubricant base material in which is dissolved a polyalkylene. This composition provides similar performance characteristics to those of conventional lead containing lubricant compositions in threaded tube or pipe connections. The absence of metals in the compositions of the invention contribute to easing the problem of pollution of surface waters and sea waters. The compositions also provide better sealing properties in o-ring couplings and they are also suitable for use as threaded connections of fibreglass.

The invention further provides a method of forming a threaded connection between a male part and a female part which comprises applying a lubricant composition as described above to at least one part and screwing together the two parts.

The lubricant compositions of the present invention includes graphite in place of the previously used lead particles, and in order to provide required performance characteristics the composition also comprises a dissolved polyalkylene. If the lubricant composition comprising graphite, with no added polyalkylene is subjected to extreme pressure during lubrication, the graphite material will form flakes in similar fashion to the metallic lead particles used in API Modified Thread Compound. However, the graphite flakes will be considerably smaller in size than the lead flakes, normally measuring a maximum of 0.5 mm, and these flakes will have insufficient strength, to withstand the forces exerted upon them within the threaded connection. The flakes will tend to fracture and break up into small particles which can then be eliminated from the threaded connection. Therefore graphite alone will not match the performance characteristics provided by API Modified Thread Compound, or other such lubricant compositions.

The lubricant composition of the invention comprises graphite which tends to form flakes under conditions of extreme pressure. The graphite should preferably have a purity of more than 80% in order to prevent any negative influence on the flaking properties by constituent impurities. Preferably, the graphite is 90 to 99% pure, and more preferably is 92 to 96% pure. It may be present in a proportion of from 10 to 70% by wight, preferably from 20 to 40% by weight, and more preferably from 40 to 50% by weight of the lubricant composition. The graphite may be crystalline or amorphous graphite.

The composition of the invention also comprises a polymeric material which is chosen from polyalkylene polymers, preferably branched polyalkylenes.

Suitable polymers include polyethylene, polypropylene and polybutylene, preferably atactic and isotactic polypropylene, ethylene propylene rubber, but the polymer is most preferably atactic polypropylene. The polymer is preferably added as a solution, and the composition suitably comprises from 5 to 40%, preferably from 10 to 20% by volume of polymer material (based on the weight of graphite in the composition).

The polymeric material will help to reduce the migration of graphite from the lubricated parts of the threaded connection on compression, and will enhance the formation of graphite flakes. It will also impart elasticity to the composition and further improve the lubricity and sealing properties of the composition. If the polymeric material is absent from the lubricating composition, the graphite flakes will tend to break up and bleed from the threaded connection on the application of pressure.

Compositions of the invention comprising graphite and dissolved polyalkylene are especially suitable for use in proprietary thread forms, and in threaded fibreglass connections. The compositions give a particular coefficient of friction when compacted, approaching that of polytetrafluoroethylene.

However, for proprietary thread forms, API-8 round thread forms and Buttress thread forms this coefficient of friction tends to be too low for some purposes and so preferably is increased by the addition of a particulate adjusting component. The adjusting component may be chosen from mica, vermiculite, calcium phosphate, magnesium phosphate, zinc phosphate, calcium oxide, magnesium oxide, zinc oxide, calcium carbonate, magnesium carbonate and zinc carbonate and is preferably mica.

The adjusting component is a friction increasing filler. The component is selected such that an increase in friction may be achieved without any substantial loss of extreme pressure characteristics. Relative movement between the parts being lubricated is still maintained, and the increase in friction surprisingly does not result in wearing or galling of the threaded connection.

The adjusting component is substantially non-abrasive, and preferably comprises small particles or plate-like particles such as mica. Materials such as talc are found to be unsuitable, probably because the particles are too small and are further reduced by wear. They will then tend to bleed from the connection.

The adjusting component is suitably present in the composition in an amount of from 5 to 70% by weight, preferably from 40 to 60%, based on the weight of graphite in the composition. The preferred adjusting component for use in the composition of the invention is mica.

A suitable parameter for measuring the value of the lubricant compositions of the invention as lubricants for threaded connections of the invention as lubricants for threaded connections is the Torque Turn Correction Factor (TTCF). This parameter is a measure of the amount of torque which has to be applied to achieve a predetermined number of turns. API Modified Thread Compound is taken as a standard and given a value of 1.

A TTCF of about 0.7 to 0.8 gives a lubricant composition suitable for use in proprietary thread forms and threaded fibreglass. Compositions having a higher coefficient of friction and suitable for use in API-8 round and buttress thread forms as well as proprietary thread forms will have a TTCF of about 1. Preferred compositions according to the invention have a TTCF as close to 1 as possible.

The performance characteristics of the lubricant composition of the invention may be further improved by the addition of an additive which may comprise any strongly polarisable or ionisable organic compound, and is preferably chosen from amines and amine salts, and metalamine complexes. Suitable amines are aliphatic aromatic and arylaliphatic mono-0, di-, tri or polyamines having primary, secondary and/or tertiary amine groups or even quaternary ammonium groups. The number of carbon atoms in the hydrocarbon chain is suitably between 1 and 30, although the material should not be volatile since it should remain in the composition as a stable component. Preferred additives are fatty amines which have been derived from naturally occurring fat and which primarily consist of a mixture of aliphatic mono or diamines. The amines may have been converted to their acid addition salts by means of a suitable organic or inorganic acid, or converted to metal-amine complexes by means of metal oxides. Preferred materials are tallow amines, tallow diamine salts, and distearyl dimethyl quaternary ammonium methylsulphate. The additive is suitably present in the composition in an amount of from 0.1 to 10% by weight, preferably from 1 to 8% by weight, based on the weight of graphite in the composition.

It is thought that the additives tends to promote the formation of graphite flakes and also to bring about an agglomeration of the flakes. The additives tends to improve the performance of the lubricant composition of the invention.

Any suitable lubricant base material may be used which is a solvent for polyalkylene. The base material preferably comprises an oil or a grease which comprises an oil together with a soap or a polyurethane. The soap is preferably present, and acts as a rheology modifier.

Suitable oils include hydrocarbon oil, animal oil or vegetable oil, and the most preferred oil is naphthalene oil.

The base material may optionally also comprise thickening agents such as modified clays, fillers such as metal oxides or metal sulphides and other conventional additives such as e.g., anti-oxidation and anti-corrosion agents.

The invention is further illustrated by the following examples, in which all quantities are expressed as parts by weight.

EXAMPLES

Example 1

30% by weight of crystalline graphite,

20% by weight of amorphous graphite (filler), 7.5% by weight of isotactic polypropylene (based on crystalline graphite), 1.75% by weight tallow diamine (based on crystalline graphite), and the balance a petroleum oil-based grease containing a metal soap (lithium 12-hydroxystearate).

Example 2

45% by weight of crystalline graphite (purity 92 to 96%),

5% by weight atactic polypropylene (based on the total composition),

1% by weight tallow diamine (based on the total composition),

1% by weight neodecanoic acid (based on the total composition),

6% by weight by calcium dodecylbenzene sulphonate,

3% by weight by magnesium oxide, and the balance being a grease based on petroleum oils.

Examples 3 and 4

The following lubricant compositions were prepared according to the invention, and were applied between the male and female parts of API 8 round threaded connections, and the TTCF of the compositions was calculated. Quantities are given as parts by weight.

| | Example 3 | Example 4 |
|---|---|---|
| H 180 | 42.0 | 43.67 |
| Atactic polypropylene | 5.0 | 3.33 |
| Tallow diamine | 1.0 | 1.0 |
| Versatic acid | 1.0 | 1.0 |
| Crystalline graphite | 20.0 | 30.0 |
| Mica | 25.0 | 15.0 |
| TTCF | 1.016 | 0.998 |

H 180 is a naphthalene oil containing calcium dodecylbenzene sulphate.

The measured values of TTCF of 1.016 and 0.998 for the compositions of Examples 3 and 4 are close to the standard value of 1, and compositions of Examples 3 and 4 are suitable for use as lubricant compositions in proprietary, API 8 round and buttress thread forms.

Comparative Example

The compositions of Examples 3 and 4 were made up, in the absence of the adjusting component, mica, and TTCF values of 1.100 and 1.081 respectively were measured. Reference compound API Modified Thread Compound has a TTCF value of 1, and it has been found that thread compounds according to the invention can be made, such as those of Examples 3 and 4 which match that performance.

Examples 5 and 6

| | Example 5 | Example 6 |
|---|---|---|
| H 180 | 44.75 | 45.34 |
| Atactic polypropylene | 2.25 | 1.66 |
| Tallow diamine | 1.0 | 1.0 |
| Versatic Acid | 1.0 | 1.0 |
| Crystalline Graphite | 20.0 | 15.0 |
| Mica | 25.0 | 30.0 |
| TTCF | 1.154 | 1.232 |

Example 7

Lubricant compositions of different formulations were applied between the male and female parts of API 8 round threaded connections whereupon these connections were made up and loosened several times until seizure took place and the parts were torn apart. The compositions used (percentages of graphite, talc, tallow diamine and atactic polypropylene (APP) in the composition, with lithium based grease as a balance) as well as the test results (average number of times that the connections could be made up and loosened in each of four tests) are represented in the following table. It should be noted that tests 1–5 and 7–9 were conducted at the same time and that tests 6 and 10 were also conducted at the same time.

TABLE

| Test No. | Composition: Graphite | Talc | Tallow Diamine | APP. | Test Results |
|---|---|---|---|---|---|
| 1 | 30 | 15 | — | — | 5.50 |
| 2 | 30 | 15 | 0.5 | — | 6.75 |
| 3 | 30 | 15 | — | 0.5 | 5.50 |
| 4 | 30 | 15 | 0.5 | 0.5 | 7.25 |
| 5 | 30 | — | — | — | 6.25 |
| 6 | 45 | — | — | — | 7.25 |
| 7 | 30 | — | 0.5 | — | 12.50 |
| 8 | 30 | — | — | 0.5 | 6.25 |
| 9 | 30 | — | 0.5 | 0.5 | 14.25 |
| 10 | 42.5 | — | 2.5 | 5.0 | 17.00 |

It can be seen from the table that addition of APP generally maintains or improves performance, and combinations of tallow diamine and APP have a positive effect on the performance characteristics of graphite in the composition, whereas talc has a negative effect under all circumstances. Composition no. 9 was substantially equivalent in performance to A Modified Thread Compound and composition no. 10 showed even better performance.

I claim:

1. A metal free lubricant composition for threaded connections which consists essentially of graphite dispersed in a lubricant base material in which a polyalkylene is dissolved, said graphite being present in an amount which is effective to decrease a coefficient of friction of said composition, and said polyalkylene being present in an amount effective to enhance formation of graphite flakes from graphite particles upon application of pressure, said composition also including a substantially non-abrasive, friction increasing adjusting component dispersed in the base material in an amount effective to increase a coefficient of friction of said composition.

2. A composition according to claim 1 wherein the adjusting component is selected from mica, vermiculite, calcium phosphate, magnesium phosphate, zinc phosphate, calcium oxide, magnesium oxide, zinc oxide, calcium carbonate, magnesium carbonate and zinc carbonate.

3. A composition according to claim 1 in which the adjusting component is mica.

4. A composition according to claim 1 which further comprises an additive chosen from amines and amine salts, and metal-amine complexes.

5. A composition according to claim 4 in which the additive is a fatty amine.

6. A composition according to claim 1 in which the amount of graphite is from 10 to 70% by weight.

7. A composition according to claim 6 in which the amount of graphite is from 20 to 40% by weight.

8. A composition according to claim 1 in which the amount of the polyalkylene is from 5 to 40% by volume based on graphite.

9. A composition according to claim 8 in which the amount of the polyalkylene is from 10 to 20% by volume based on graphite.

10. A composition according to claim 1 in which the polyalkylene is atactic polypropylene.

11. A composition according to claim 1 in which the amount of the said adjusting component is from 5 to 50% by weight based on graphite.

12. A composition according to claims 4 or 5 in which the amount of the additive is from 0.1 to 10% by weight based on graphite.

13. A composition according to claim 1 in which the lubricant base material is selected from oils and greases comprising an oil containing a soap, wherein the oils are selected from hydrocarbon oil, animal oil and vegetable oil.

14. A method of forming a threaded connection between a male part and a female part which comprises applying a lubricant composition according to claim 1 to at least one of the said male and female parts and screwing together the said male and female parts.

* * * * *